US011346553B2

(12) United States Patent
Bratti et al.

(10) Patent No.: US 11,346,553 B2
(45) Date of Patent: May 31, 2022

(54) GAS VALVE UNIT

(71) Applicant: Defendi Italy S.r.l., Camerano (IT)

(72) Inventors: Lorenzo Bratti, Camerano (IT); Paolo Luchetta, Camerano (IT); Werner Noeth, Camerano (IT)

( * ) Notice: Subject to any disclaimer, the term of this patent is extended or adjusted under 35 U.S.C. 154(b) by 315 days.

(21) Appl. No.: 16/616,369

(22) PCT Filed: May 24, 2018

(86) PCT No.: PCT/IT2018/050092
§ 371 (c)(1),
(2) Date: Nov. 22, 2019

(87) PCT Pub. No.: WO2018/216044
PCT Pub. Date: Nov. 29, 2018

(65) Prior Publication Data

US 2020/0103108 A1 Apr. 2, 2020

(30) Foreign Application Priority Data

May 26, 2017 (IT) ..... 102017000057665

(51) Int. Cl.
*F23D 5/16* (2006.01)
*F23N 1/00* (2006.01)
(Continued)

(52) U.S. Cl.
CPC ..... *F23N 1/007* (2013.01); *F23N 1/005* (2013.01); *F23K 5/007* (2013.01);
(Continued)

(58) Field of Classification Search
CPC .. F23N 1/007; F23N 2235/16; F23N 2235/24; F16K 11/074
See application file for complete search history.

(56) References Cited

U.S. PATENT DOCUMENTS 4,643,215 A * 2/1987 Phlipot ..... F16K 3/08 137/15.01
5,102,039 A * 4/1992 Yothers ..... F23N 1/007 236/15 A
(Continued)

FOREIGN PATENT DOCUMENTS

CN 201103717 8/2008
EP 2786073 10/2014
(Continued)

*Primary Examiner* — Reinaldo Sanchez-Medina
(74) *Attorney, Agent, or Firm* — Themis Law

(57) ABSTRACT

A gas valve unit to be connected to a gas source includes a body having an inlet, a main chamber in the body communicating with the inlet and having a main outlet communicating with the outlet of the gas valve unit, a disc-shaped element in the main chamber with one or more openings putting the main chamber in communication with the main outlet hole and rotatable between a closing position, where the main outlet hole is entirely covered by the disc-shaped element, and at least two opening positions in which the one or more openings face, at least in part, the main outlet hole to enable gas passage from the main chamber to the main outlet hole via the through opening, and a control unit associated causing the snapping rotation of the disc-shaped element between the closing position and an opening position, and between the at least two opening positions.

20 Claims, 6 Drawing Sheets

(51) Int. Cl.

| | |
|---|---|
| *F23K 5/00* | (2006.01) |
| *F23N 5/10* | (2006.01) |
| *F24C 3/12* | (2006.01) |

(52) U.S. Cl.

CPC ..... *F23K 2900/05001* (2013.01); *F23K 2900/05002* (2013.01); *F23N 5/107* (2013.01); *F24C 3/126* (2013.01)

(56) References Cited

U.S. PATENT DOCUMENTS

| | | | | |
|---|---|---|---|---|
| 5,799,698 | A * | 9/1998 | Lin | F23N 1/007 137/628 |
| 2004/0182456 | A1* | 9/2004 | Rousselin | G05D 7/0186 137/625.3 |
| 2005/0150555 | A1* | 7/2005 | James | F16K 31/524 137/599.16 |
| 2018/0320794 | A1* | 11/2018 | Querejeta Andueza | F16K 11/074 |
| 2018/0320795 | A1* | 11/2018 | Querejeta Andueza | F23K 5/147 |

FOREIGN PATENT DOCUMENTS

| | | |
|---|---|---|
| GB | 662896 | 12/1951 |
| JP | S558575 | 1/1980 |
| JP | S5572958 | 6/1980 |
| WO | 2013175438 | 11/2013 |

* cited by examiner

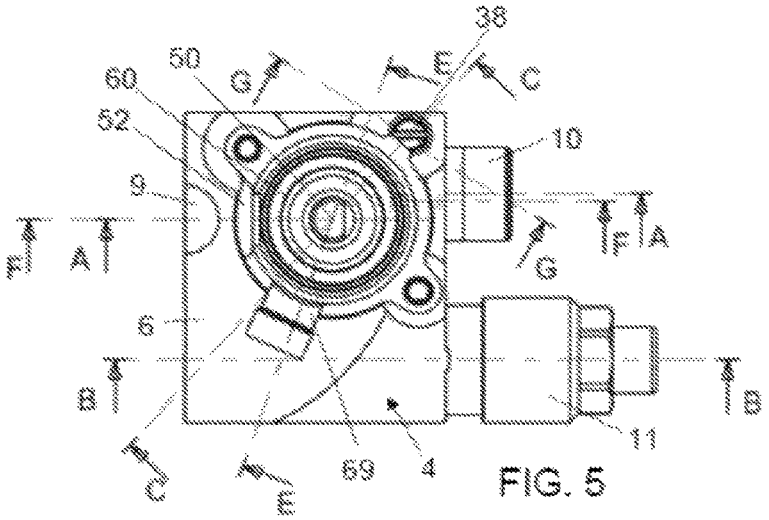
FIG. 5
FIG. 6
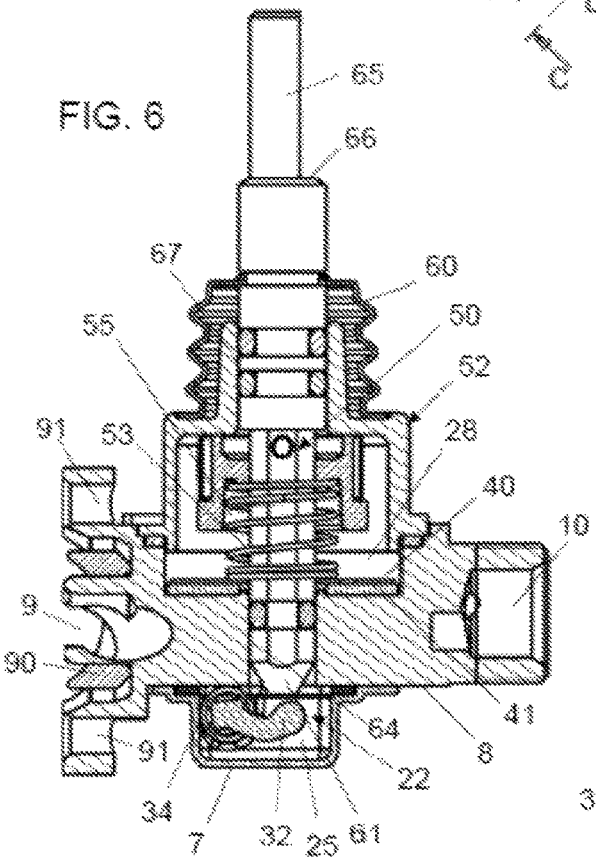
FIG. 7
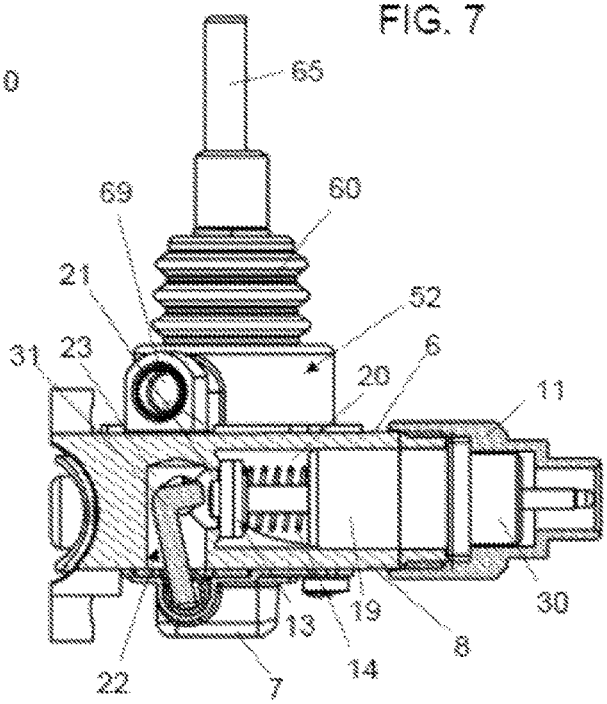

FIG. 13
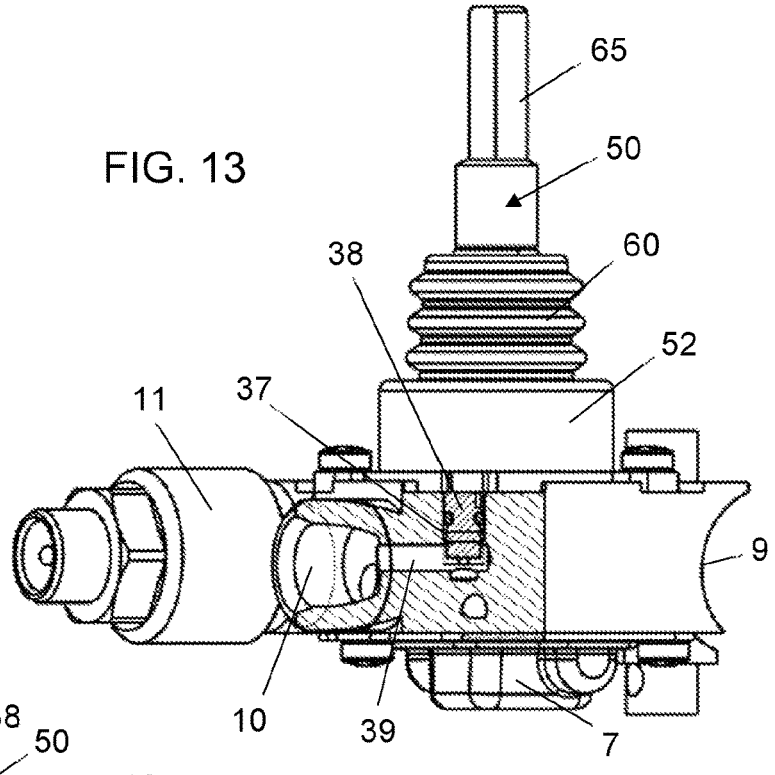
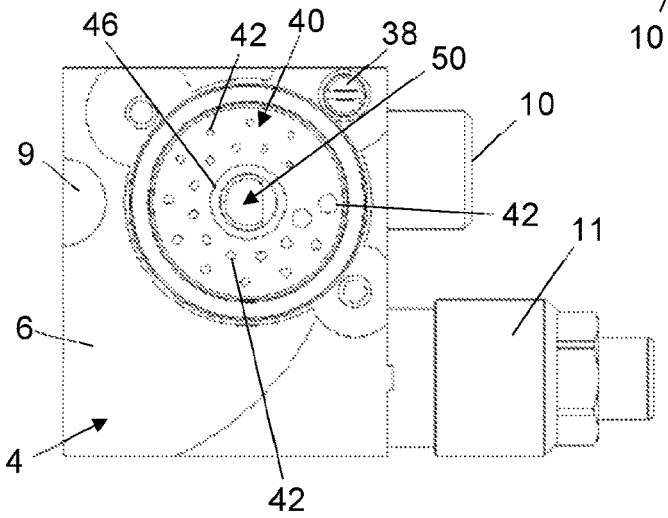
FIG. 14
FIG. 15
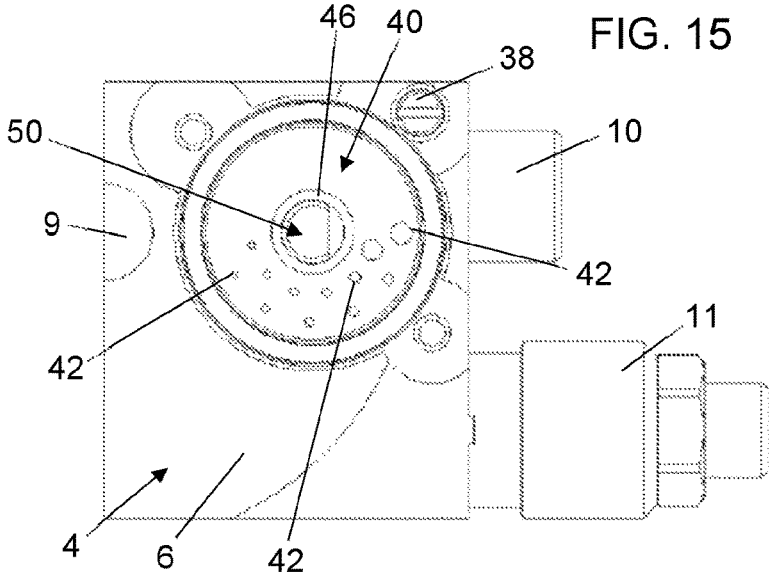

GAS VALVE UNIT

FIELD OF THE INVENTION

The present invention relates to an improved gas valve unit, particularly for adjusting the gas to be sent to a gas burner.

BACKGROUND OF THE INVENTION

Many types of valve assemblies for regulating the flow of gas to a burner are known, such as those in which the gas passage section, and thus the gas outflow from the valve unit, is regulated by specific on-off valves which either open or close the corresponding gas outlet openings.

In these known valve assemblies, on-off valves can be electromagnetically operated, e.g. individually controlled, by means of an electronic control unit, an electromagnet which is associated with each on-off valve, or may be actuated mechanically, e.g. by moving a body which in sequence causes the opening or closing of the on-off valves.

In particular, WO2014139844 describes a valve unit in which the inlet is connected to the outlet by means of a plurality of on-off valves, each of which comprises a vertically movable cylindrical shutter and a corresponding spring which acts on the shutter so as to push it towards a seal and thus close the gas passage opening associated with each on-off valve. Furthermore, the valve unit comprises an actuator element which acts on the shutter, in contrast with respect to said spring, so as to move it away from the seal and so allow the opening of the valve and therefore of the corresponding passage of gas. This solution is not optimal because it is particularly complicated from the construction point of view and is thus rather expensive and, moreover, it is necessarily larger than standard valve assemblies because it is not possible to miniaturize the cylindrical shutters of the on-off valves appropriately and to insert the corresponding seals at the gas passages. Furthermore, the larger and different sizes of such solution require using a specific, custom attachment of valve unit to the gas inlet rail, which attachment is incompatible, and not interchangeable, with the one generally used on the currently marketed cooktops.

Furthermore, the control unit of such valve unit allows a continuous adjustment between the various power levels, not allowing a correct and precise positioning at said levels at all.

EP2786073 describes a valve unit with a body which has an inner cavity, communicating with an inlet and a gas outlet, and a disc, which continuously rotates with respect to the inner cavity of said body and which is provided with at least two connecting holes, which selectively either connect or disconnect the inner cavity to or from the gas inlet and outlet. In particular, in this solution, the rotating disc, which is actuated in rotation by a rotating shaft, is pushed by an elastic element and a thrust bearing, both fitted about said rotating shaft, to remain in direct contact with the surface of the inner cavity of the valve body. This solution is not entirely satisfactory because the direct contact, and thus the sliding, of the rotating disc with respect to the surface of the inner cavity of the valve body causes a greater wear of the disc itself with an unavoidable reduction of the cycles of use of the valve unit. Furthermore, this solution does not guarantee an optimal gas-tightness and, additionally, the direct contact of metal disc with the metal surface of the inner cavity causes negative effects related to the thermal expansion of these elements.

GB662896 describes a valve unit with a body which has an inner cavity communicating with a gas inlet and outlet, which are both defined on the same wall of the body itself; a disc is further provided, covered on the top by an annular passage, which continuously rotates with respect to the inner cavity of said body and which is provided with at least two connecting holes in order to put the gas inlet into communication with the gas outlet; in particular, in the valve unit of GB662896, the disc adjusts the gas entering and exiting to and from the inner cavity of said body.

In particular, in the valve unit of GB662896, the disc rests on the same wall of the chamber on which gas inlet connection hole is defined; such configuration is not satisfactory in terms of safety because an overpressure of the inlet gas would tend to cause the lifting of the disc towards the inside of the chamber precisely because the direction of gas flow into the chamber is the same as a possible lifting of the disc.

Furthermore, the valve unit of GB662896 comprises a closing element, which is integral in rotation with the control rod of the valve unit and which cooperates with four recesses defined on a closing lid of said body. In particular, while a single recess has sharp edges and identifies the closing position of the valve unit, the other three recesses have rounded edges and identify three different opening positions of the unit itself. Therefore, in this situation, only the insertion of the closing element in the recess with sharp edges, which identifies the closing position of the valve unit, gives the tactile sensation of a snapping engagement to the operator, while the passage of the closing element in the recesses with rounded edges occurs in sliding and gradual manner, i.e. without any tactile snapping engagement. This solution is not completely satisfactory because it does not allow a precise, reliable and repeatable adjustment between different opening conditions.

CN201103717 describes a valve unit with a body—consisting of two parts which, when joined together, define an inner cavity communicating with a gas inlet and two gas outlets—and with an adjustment unit consisting of a plurality of elements. In particular, such adjustment unit comprises a rotating disc, which is provided with a single through hole and which is driven in rotation by a rotating shaft, and further comprises a plate having a semicircular shape, in which a plurality of through holes of different sizes are defined, which is fixed at the gas outlet hole; in particular, such outlet hole must also have a semicircular shaped mouth of suitable size suited for housing/inserting said semicircular plate. So, according to the angular position of the rotary shaft and of the rotating disc, the only through hole defined in the latter is made to face the different through holes obtained in the fixed semicircular plate, thus selectively putting the inner cavity into connection with the gas outlet hole. Substantially, in the solution of CN201103717, the gas flow rate is varied by obtaining different through holes on the components which are fixed and not rotating. Furthermore, two additional discs are interposed between the rotating disc and the stationary plate, which additional discs are provided with a plurality of holes (all having the same size and corresponding to that of the single hole provided in the rotating disc) which are constrained/fixed to the valve unit body (i.e. do not rotate together with the rotating disc). This solution is not completely satisfactory because it is rather complicated and therefore costly to be manufactured. Furthermore, this solution requires the gas outlet hole to be rather large in size because it must allow the housing of a fixed plate in which all possible holes—of mutually different sizes—which are provided for each specific application are obtained.

EP3211308 and EP3211309 describes a valve unit with a body which has an inner cavity, communicating with an inlet and a gas outlet, and a disc which continuously rotates with respect to the inner cavity of said body and which is provided with a plurality of connecting holes which selectively either connect or disconnect the inner cavity and the gas outlet. In particular, in this solution, the rotary disc, is actuated in rotation by a rotating shaft and by a control unit which cause the continuous rotation of the disc itself. Substantially, in EP3211308 and EP3211309, there is no element which identifies the different angular positions of the rotating disc in fixed/unique manner, and which thus allows to define the amount of gas exiting from the valve unit in precise and repeatable manner. This solution is not completely satisfactory because it does not allow a precise, reliable and accurate adjustment between different open conditions nor does allow to identify the closing condition in appropriate manner.

SUMMARY OF THE INVENTION

It is an object of the invention to suggest an improved gas valve unit which is free from the drawbacks of the traditional valve assemblies used in this context.

It is another object of the invention to suggest a compact size valve unit.

It is another object of the invention to suggest a valve unit which allows to modulate the outlet gas flow on multiple levels and which, at the same time, ensures an excellent gas-tight sealing in the closing condition.

It is another object of the invention to suggest a valve unit which allows a high and easy customization of various outlet gas flow levels.

It is another object of the invention to suggest a valve unit which allows a high number of cycles of use.

It is another object of the invention to suggest a valve unit which can be adjusted accurately, reliably and repeatably.

It is another object of the invention to suggest a valve unit which reduces any wobble of the control rod with respect to its longitudinal axis.

It is another object of the invention to suggest a valve unit which has a high degree of insulation from the external installation context, whereby eliminating any possibility of accidental introduction of liquids or substances inside the unit itself.

It is another object of the invention to suggest a valve unit which can be used with different types of gas and in which itis particularly simple to pass from one type of gas to another.

It is another object of the invention to suggest a valve unit which is completely interchangeable with those already existing on the market.

It is another object of the invention to suggest a valve unit which displays an alternative and/or improving characterization, in both construction and functional terms, with respect to the traditional ones.

It is another object of the invention to suggest a valve unit of simple construction which can be made at low industrial costs.

All these objects, individually and in any combination thereof, and others which will become apparent from the following description, are achieved, according to the invention, by an improved gas valve unit having the features disclosed hereinafter.

BRIEF DESCRIPTION OF THE DRAWINGS

The present invention is further explained by means of a preferred embodiment given by way of non-limiting practical example only with reference to the accompanying drawings, in which:

FIG. 5 shows a top plan view thereof, FIG. 6 shows the vertical section thereof taken along A-A in FIG. 5, FIG. 7 shows the vertical section thereof taken along B-B in FIG. 5, FIG. 13 shows the vertical section thereof taken along G-G in FIG. 5, FIG. 14 shows a perspective view taken along the horizontal section H-H in FIG. 9 with a first embodiment of the disc-shaped element, FIG. 15 shows a perspective view taken along the horizontal section H-H in FIG. 9 with a second embodiment of the disc-shaped element.

DETAILED DESCRIPTION OF EMBODIMENTS OF THE INVENTION

Figure 1:
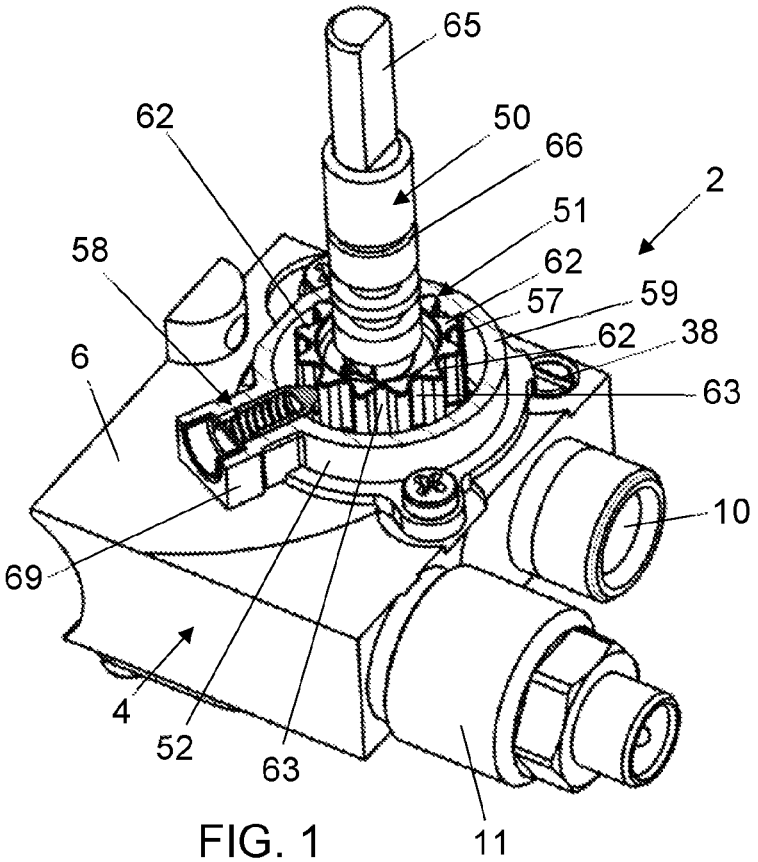
FIG. 1 shows a perspective top view of a valve unit according to the invention with its control unit partially sectioned.
Figure 2:
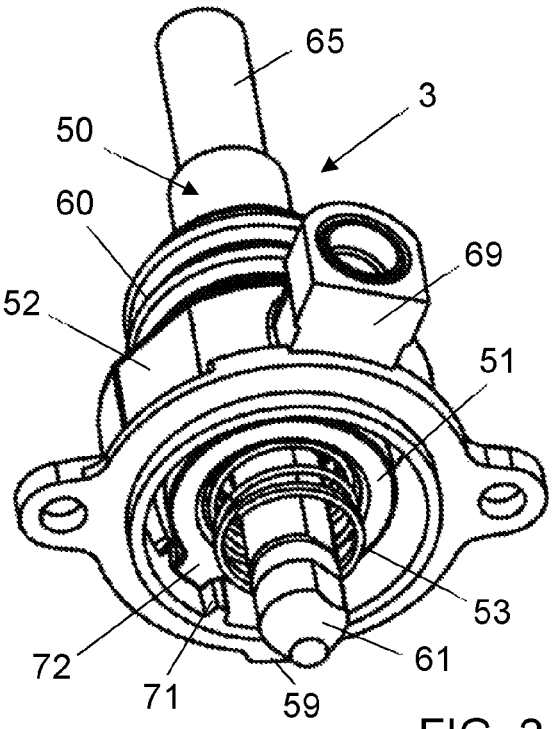
FIG. 2 shows a view from the bottom of its control element.

As can be seen in the figures, the improved gas valve unit 2, according to the invention, particularly for controlling/modulating the gas to be sent to a gas burner, substantially comprises a control unit 3 which is associated with a body 4.

Preferably, the body 4 is metallic, and in particular made of extruded aluminum, in which a series of gas passages and a series of chambers or cavities for housing particular functional components, which will be described in greater detail below, are obtained by mechanical machining. Appropriately, the body 4 may be defined in one piece or by several pieces joined to one another.

Advantageously, the body 4 has a substantially box-like shape 5, preferably of parallelepiped shape, with a first face 6, with which the control unit 3 is associated, and a second face 8, opposite and parallel to the first, with which a lid 7 is associated. Appropriately, the lid 7, which is made of aluminum sheet or other material, even non-metallic, is fixed to the second face 8 of the body 4 and a contoured seal is interposed between them to ensure the sealing of such constraint.

The gas inlet 9, which is fluidly connected to the external source, and the gas outlet 10, which is fluidically connected with a gas burner to be fed, are formed respectively on the body 4, preferably at its side faces. Preferably, the gas inlet 9 and the gas outlet 10 are obtained on the two mutually opposite side faces of the body 4.

Advantageously, at the side face of the body 4 on which the gas inlet 9 is formed, a housing is also provided for a contoured seal 90 which is interposed between the body 4 and the pipe (not shown) connecting to the gas supply line. Appropriately, two threaded holes 91 are obtained on the body 4, symmetrically with respect to such seat, to allow the fixing of the valve unit 2 to the connecting pipe by means of one or more screws which engage a contoured bracket (not shown).

Advantageously, a protruding pipe stretch is provided at the side face of the body 4 on which the gas outlet 10 is obtained.

A first chamber 20 is obtained inside the body 4, preferably of a substantially cylindrical shape, which defines a housing for the safety valve 12, together with a cap 11 which protrudes laterally from the body itself. Appropriately, such cut-off valve 12 is of traditional type and is preferably configured to have only two states (i.e. is of the on-off type) to either allow or prevent the passage of the gas flow according to its state.

In particular, the safety valve 12 comprises a shutter 13, associated with a spring 14, which in the absence of external stresses keeps a passage 21 which put the first chamber 20 into communication with a second chamber 22 closed. The spring 14 is arranged to push the shutter 13 in the same direction as the gas which acts on it. Preferably, the portion of the shutter 13 which acts at the passage between the chambers 20 and 22 is flat and disc-shaped.

The shutter 13 of the safety valve 12 is axially movable between an extreme closing position, which is kept by the spring 14, as mentioned, and an opposite extreme opening position, which may be reached following the action of a first arm 31 of an actuating linkage 30. Appropriately, the first arm 31 of the linkage 30 acts on the rod which supports the shutter 13, whereby applying a push greater than the elastic reaction of the spring 14.

In its opening position, the body 19 of the safety valve 12, which is made of ferrous material, is subject to the attractive action of an electromagnet 17, which is aligned with the shutter 13. The first chamber 20 is closed by the plug 11 which retains electromagnet 17, the tightness of which with a corresponding tubular protruding stretch of the body 4 ensures a proper sealing of such chamber.

The first chamber 20 communicates with the gas inlet 9 through a first conduit 24, while the second chamber 22 communicates via a second conduit 26 with a main chamber 28, preferably of essentially cylindrical shape, in which a disc-shaped element 40 is housed.

In more detail, the second chamber 22 comprises a cavity 23, which is formed inside the body 4, and which communicates directly with the passage 21, with the second conduit 26 and with a sub-chamber 25 which is defined between the second face 8 of the body 4 and the cover 7.

The control linkage 30, which may be made of plastic or metal material, comprises a first arm 31, which is housed inside the cavity 23, and a second arm 32 which is housed in the sub-chamber 25. Advantageously, the two arms 31 and 32 of the control linkage 30 are arranged orthogonally to each other and are connected by a connecting stretch 33, which is also housed in the sub-chamber 25. More in detail, an element 34, preferably of annular shape, is provided inside the sub-chamber 25, which element is fixed to the cover 7 and/or to the second face 8 of the body 4, or is stably retained between them, and is configured to support the control linkage 30 allowing, in all cases, its rotation, which is caused by the axial movement of the rod 50 of the control unit 3, as explained in greater detail below.

The main chamber 28 has, preferably at its bottom, a main outlet hole 27 which communicates with the gas outlet 10 through a third conduit 29.

Advantageously, the main chamber 28 also has an auxiliary outlet hole 36, which cannot be closed by the disc-shaped element 40 and which communicates with the gas outlet 10 through a fourth chamber 37, thereby constituting a bypass circuit of the disc-shaped element 40. Appropriately, the bypass circuit can be either closed or open, even in controlled manner, by varying the axial position of an adjustment screw 38 which is conveniently housed inside the fourth chamber 37.

In particular, the auxiliary outlet hole 36 communicates with a first zone (preferably lower) of the fourth chamber 37 inside which the adjustment screw 38, which is used to change the type of gas, is positioned. Appropriately, a second zone (preferably upper) of the fourth chamber 37 then communicates with the gas outlet 10 through a fourth conduit 39.

As mentioned, the disc-shaped element 40 is provided inside the main chamber 28, at the wall on which the main outlet hole 27 is obtained.

Advantageously, the inlet section of the main outlet hole 27 is smaller than the disc-shaped element 40, in particular in its extension in plan view.

The disc-shaped element 40 has central through hole 41 which is crossed by the rod 50 of the control unit 3, said at least one through opening 42, 49 being appropriately formed on the circular-crown-shaped portion 47 defined around said through hole 41.

Said at least one through opening 42 or 49 obtained in the disc-shaped element 40 defines at least two passage zones—which have mutually different passage sections—to put the main chamber 28 into communication with the main outlet hole 27.

The disc-shaped element 40 is movable in rotation within the chamber 28 between:

at least one closing position, in which the main outlet hole 27 is entirely covered by a full portion of the disc-shaped element 40, and at least two distinct and preferably successive opening positions, in each of which corresponding distinct and transit areas—having passage sections, defined in/from said at least one through opening 42, 49 of the disc element 40, which are mutually different—face, at least in part, the main outlet hole 27 so as to allow the passage of gas from the main chamber 28 to the main outlet hole 27 through such passage zone defined in/from said at least one through opening 42, 49.

The control unit 3 associated with means for causing the snapping rotation of said disc-shaped element 40 between said closing position and an opening position, and for causing the snapping rotation of said disc-shaped element 40 between said at least two distinct opening positions.

Figure 3A:
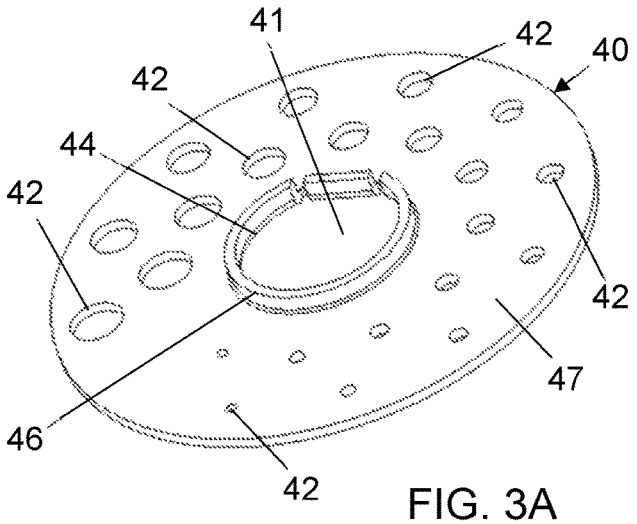
FIG. 3*a* shows a perspective view of a first embodiment of the disc-shaped element.

In particular, a plurality of through openings 42, which are mutually separated and of various sizes, are provided in a first embodiment of the disc-shaped element (Cf. FIG. 3*a*). Preferably, the through openings 42 have a circular shape with different diameters. Appropriately, the through openings 42 define—either alone or in combination with the adjacent openings—the zones with different passage sections to put the main chamber 28 into communication with the main outlet hole 27.

Figure 3B:
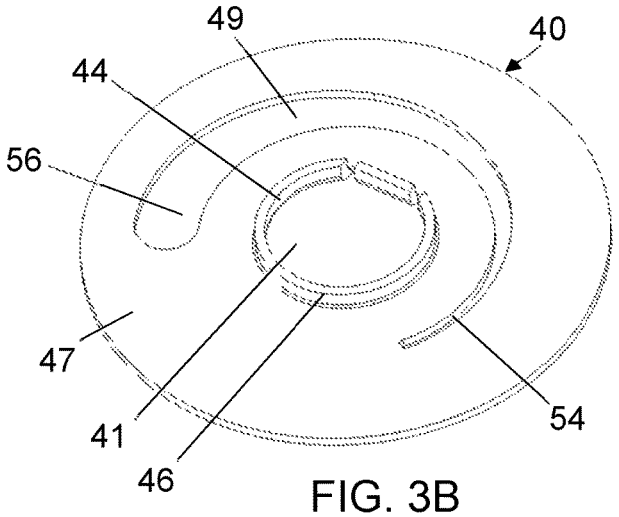
FIG. 3*b* shows a perspective view of an alternative embodiment of the disc-shaped element.
Figure 4:
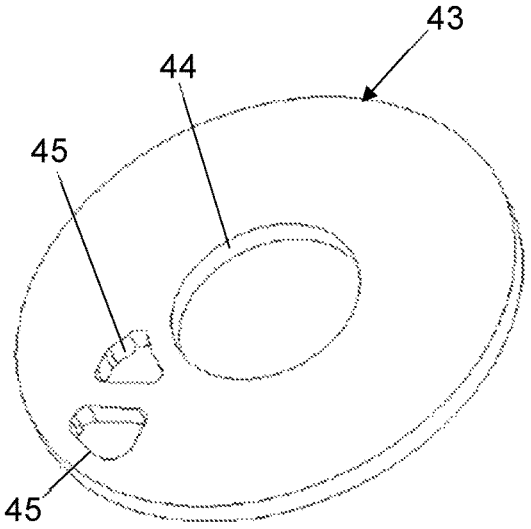
FIG. 4 shows a perspective view of the seal under the disc-shaped element.
Figure 8:
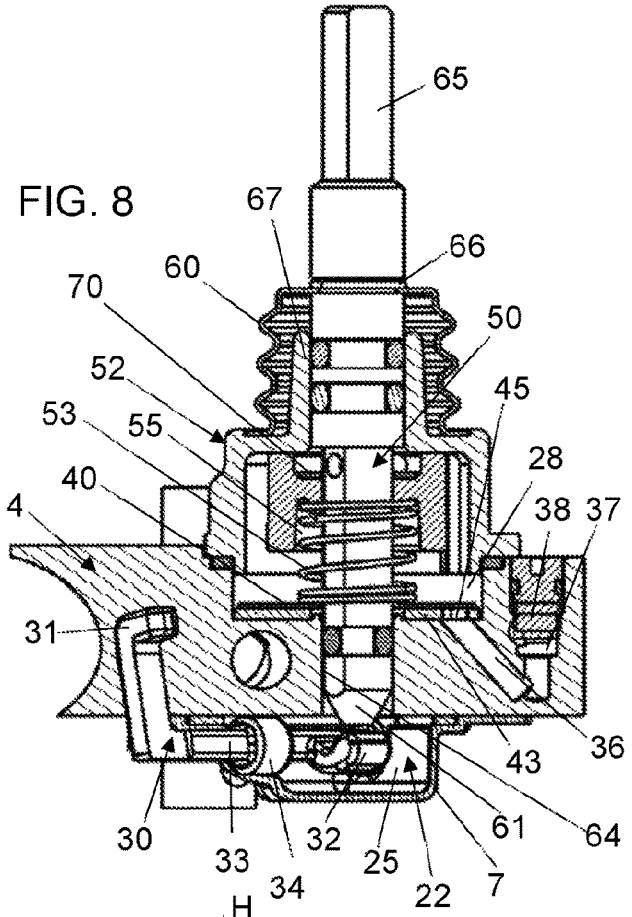
FIG. 8 shows the vertical section thereof taken along C-C in FIG. 5.
Figure 9:
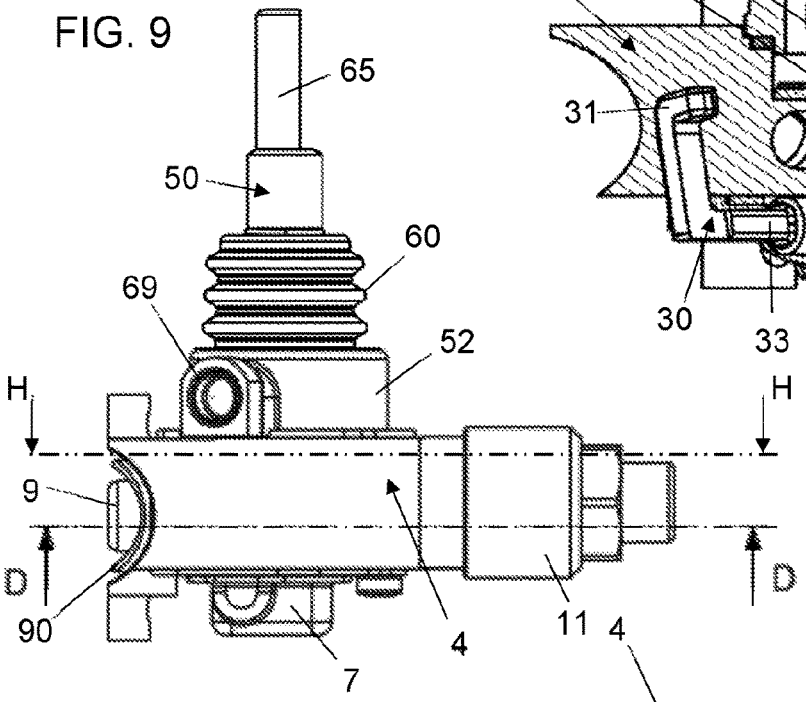
FIG. 9 shows a side view thereof.
Figure 10:
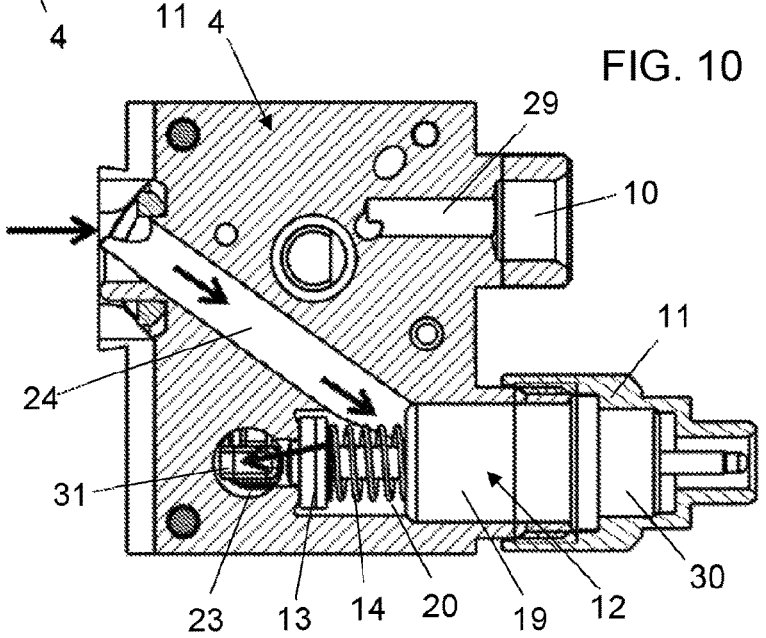
FIG. 10 shows a horizontal section thereof taken along D-D in FIG. 9 with the gas flow indicated.
Figure 11:
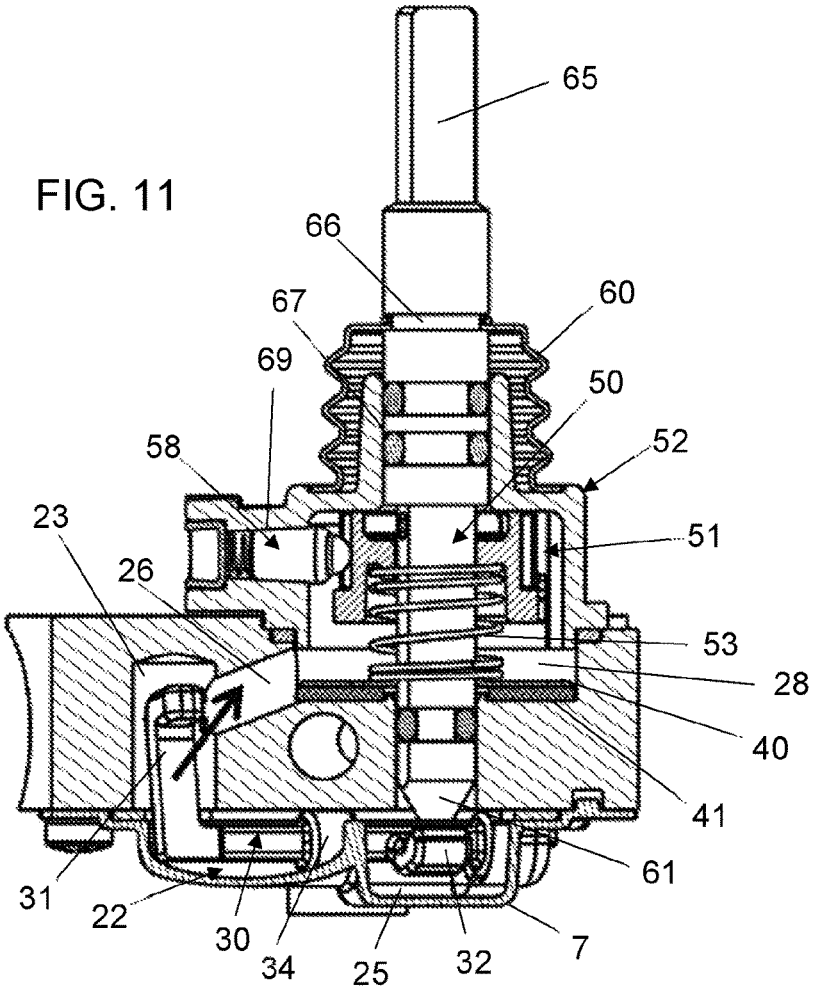
FIG. 11 shows the vertical section thereof taken along E-E in FIG. 5.
Figure 12:
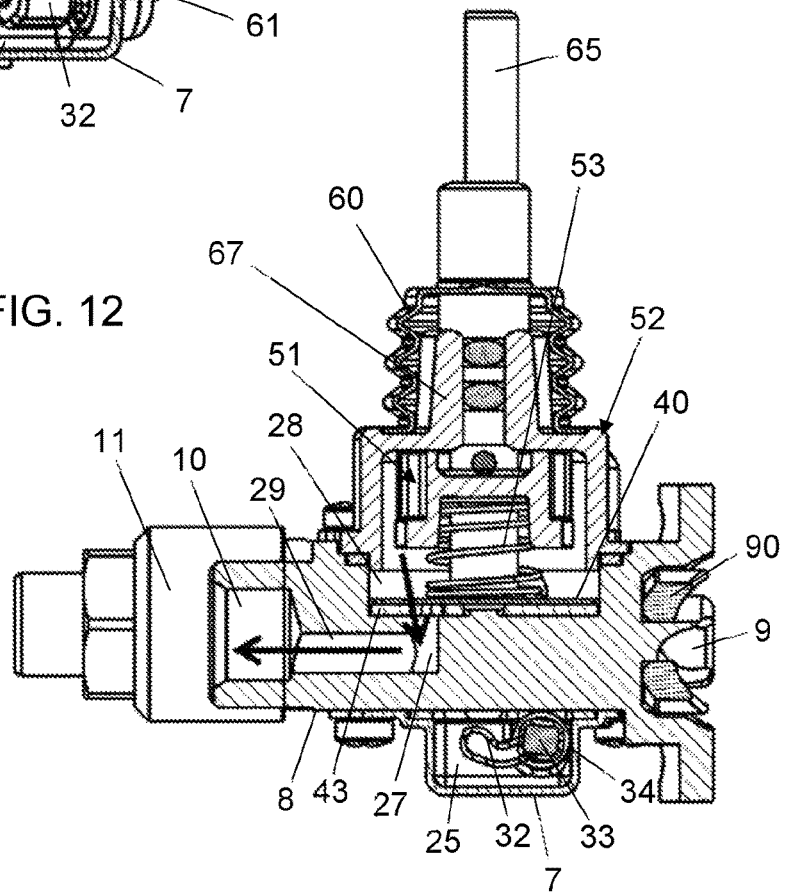
FIG. 12 shows the vertical section thereof taken along F-F in FIG. 5.

In an alternative embodiment (Cf. FIG. 3*b*), a single through opening 49 is provided, which is continuous and contoured so as to vary the passage gap, to allow the modulation of the gas flow in a progressive manner. Appropriately, the continuous through opening 49 comprises a plurality of zones and can have any variation of shape and/or size along its circumferential extension. Advantageously, the continuous through opening 49 defines, by means of the plurality of different zones which compose it, a passage gap which varies in increasing or descending manner, both progressively and a discontinuously, or can have any other suitable variation of shape and/or size according to the gas flow modulation requirements required in a specific application. Appropriately, the zones which form the single continuous through opening 49 define the zones with different passage sections to put the main chamber 28 into communication with the main outlet hole 27.

For example, as shown in FIG. 3*b*, the through opening 49 is preferably contoured so as to increase its radial size gradually and continuously from a narrower area 54 towards a wider area 56.

Advantageously, the main chamber 28 is put into fluid communication with the gas inlet 9 independently from the angular position of the disc-shaped element 40. In particular, the disc-shaped element 40 is housed in the main chamber 28 to act exclusively at the main outlet hole 27. Appropriately, the wall of the main chamber 28 at which the disc-shaped element 40 acts (and in which the main outlet hole 27 is formed) is different/distinct from the wall of the main chamber 28 provided with at least one inlet hole, which is in fluid communication with the gas inlet 9.

Appropriately, the fact that the disc-shaped element 40 does not act on the wall of the main chamber 28, which is placed in fluid communication with the gas inlet 9 (or in all cases acting on a separate wall) is advantageous in terms of safety because a possible overpressure of the gas let into the main chamber 28 does not compromise the tightness of the entire valve unit 2; indeed, in the present solution, such possible overpressure would tend at most to more to push the disc-shaped element 40 against the wall of the chamber 28 on which only in the main outlet hole 27 is formed and, conveniently, would tend to push it against a sealing element 43 interposed between the disc-shaped element itself and said wall.

Advantageously, the contour of the cross section of the through hole 41 of the disc-shaped element 40 corresponds to that of the rod 50 of the control unit 3 so that the latter is integrally in rotation, but free to move longitudinally with respect to the disc-shaped element 40. More in detail, for this purpose, the through hole 41, and thus also the corresponding lower portion of the rod 50 which passes therethrough, may have an overall circular cross-section with a rectilinear stretch.

Appropriately, in the embodiments shown in FIGS. 3*a* and 3*b*, in order to modulate the outlet gas flow on multiple levels, the disc-shaped element 40 comprises a plurality of through openings 42, separated from each other and of increasing size, or a single through opening 49, which is contoured so as to define a gradually increasing passage area, however it is understood that, in an embodiment not shown here, such disc-shaped element 40 may also have a single through opening 42, preferably having a substantially circular shape, in order to provide an on-off type control of the outlet gas flow.

Advantageously, a sealing element 43 is interposed between the main hole 27 and the disc-shaped element 40, which sealing element is fixed (i.e. does not turn) and ensures the tightness of the valve unit 2 in closing position, in particular by preventing the leakage of gas between the through openings 42 or 49 of the disc-shaped element 40 during its rotation, whereby ensuring the correct gas flow in each angular position of the element itself. In more detail, the sealing element 43 is interposed between the disc-shaped element 40 and the bottom of the main chamber 28 at which said main hole 27 is formed. Advantageously, the sealing element 43 consists of a disc-shaped seal with a corresponding circular central hole 44, which is crossed by the rod 50 of the control unit 3, and with at least one, preferably two, further preferably contoured through openings 45, which face the main hole 27, which is preferably obtained on the bottom of the main chamber 28. Appropriately, there are two contoured through openings 45 in order to define two distinct and separate gas passages from the main chamber 28 towards the main outlet hole 27, each of which is intended to be used with only one specific type of gas.

Advantageously, the circular hole 44 of the sealing element 43 has a larger cross section than that of the rod 50 and of the disc-shaped element 40 so that the sealing element 43 remains immobile and is independent from the rotations of the rod 50 which crosses it. Preferably, the through hole 41 of the disc-shaped element 40 has a flanged edge 46 which retains it laterally and acts as a guide for the rod 50.

The control unit 3 comprises the rod 50, a contoured element 51, which integral with said rod both in rotation and in translation, and an outer covering element 52, which is fixed and integral with the first face 6 of the body 4.

The control unit 3 also comprises an elastic element 53 which acts on the face of the disc-shaped element 40, which is opposite to the one in contact with the sealing element 43. In particular, the elastic element 53, which preferably comprises a solenoid spring, is longitudinally crossed by the rod 50 and works in compression so as to push the disc-shaped element 40 into contact with the sealing element 43 so as to ensure a high level of tightness of the valve unit 2.

More in detail, while one end of the elastic element 53 acts on the disc-shaped element 40, the other end of said elastic element acts on an abutment integral with said rod 50 so as to push and hold the latter in its upper end of travel position (i.e. away from the body 4).

Preferably, such abutment is defined by the contoured element 51 which is preferably made of plastic material and which can be either fitted on the rod 50 or made in one piece with the latter. Appropriately, the contoured element 51 has an inner recess 55 that acts as a guide for the elastic element 53.

Advantageously, the contoured element 51 has a safety element housing seat 70, preferably of annular shape and metallic, which, in case of damage or the complete breaking of the contoured element itself, keeps pushing the elastic element 53 against the disc-shaped element 40 and the sealing element 43, thus ensuring a high level of tightness of the valve unit 2.

In particular, the contoured element 51 comprises a crown gear 57 which cooperates with a pusher 58 of the control unit 3 so as to define a snap-like rotation of the rotating unit consisting of the rod 50, the contour element 51 and the disc-shaped element 40. Appropriately, the snap-like rotation, which derives from the engagement of the pusher 58 in successive notches 63 defined between the teeth 62 of the crown gear 57, provides the user with a sensitive tactile (haptic) perception of the movement of said rotating unit and allows to define a plurality of angular positions of the disc-shaped element 40 in precise and repeatable way.

In particular, the engagement of the pusher 58 within a given notch 63 of the contoured element 51 corresponds to a precise and well-defined angular position of the rod 50 and to a predetermined condition of connection between the main chamber 28 and main outlet hole 27, and thus to the gas outlet 10, through a specific and well-identified passage section, which is defined by one or more through openings 42 between the plurality of separated holes obtained on the disc-shaped element 40 or which is defined by a specific and well-defined portion/zone of the contoured opening 49 obtained on the disc-shaped element 40. Appropriately, each notch 63 of the crown gear 57 corresponds a distinct passage section which is defined in/from said at least one through opening 42 or 49 defined in said disc-shaped element 40. In other words, the angular positions of the rotating unit consisting of the rod 50, the contoured element 51 and the disc-shaped element 40 are fixed and predefined (and preferably correspond to the number of notches 63 of the crown gear 57 of the shaped element) and this ensures a repeatability of the gas flow out from the valve unit 2 and to send to the burner—and thus also a repeatability of the power generated by the latter—in the various angular positions of the rod 50.

Appropriately, the pusher 58 is defined by a pin which, upon the action of a spring acting in compression, engages by snapping within the notches 63 of the crown gear 57. Advantageously, by acting on the conformation of the end of the pusher 58 which cooperates with the notches 63 of the crown gear 57 and/or on the shape/size/arrangement of notches 63 of the crown gear 57 and/or on the spring of the pusher itself, the sensitivity of the tactile perception (haptic) of the snap-like movement of the aforesaid rotating unit, as well as the force necessary to cause such movement, can be appropriately varied (according to needs).

Appropriately, in an embodiment not shown here, while always maintaining the same snapping engagement, the pusher 58 may be integral with the rod 50 so as to rotate with the latter, while the crown wheel 57 may be integral with the body 4 and, therefore, remain fixed.

The rod 50, which is preferably made of metallic material, e.g. brass or aluminum, crosses in sequence through the elastic element 53, the through holes 41 and 44 of the disc-shaped element 40 and of the sealing element 43 respectively and is inserted in a corresponding calibrated hole 64 obtained in the body 4, preferably at the bottom of the main chamber 28. Appropriately, one or more seats for corresponding seals are provided at the outer surface of the portion of the rod 50, which is positioned inside the calibrated hole 64 of the body 4, in order to allow an appropriate tightness at the coupling zones of the rod with the body 4.

The contour of the lower end 61 of the rod 50, which is positioned inside the body 4, comprises an appropriate contouring which cooperates with the second arm 32 of the control linkage 30 so as to cause the rotation of the latter and the opening of the safety valve 12 by means of the action of the first arm 31.

Appropriately, the upper portion 65 of the rod 50, which is positioned externally with respect to the body 4, is intended to be constrained to a control knob (not shown) which is gripped by the user in order to actuate the valve unit 2 and check/modulate the gas flow therethrough.

The covering element 52 externally protects the contoured element 51 and closes the top of the main chamber 28. Preferably, the outer covering element 52 is made of metallic material, e.g. sheet metal or by die-casting, or of plastic material.

In particular, the outer covering element 52 is fixed to the body 4 by means of fixing screws and, advantageously, a seal is interposed between them at the coupling zones to allow the sealing of the main chamber 28 which is defined between them.

Advantageously, the outer covering element 52 comprises a tubular portion calibrated 67 inside which a corresponding portion of the rod 50 is inserted and guided. Appropriately, one or more seats for corresponding seals are provided at the outer surface of the portion of rod 50 which crosses the calibrated tubular stretch 67 in order to allow an appropriate tightness at the coupling zones of the rod with the body 52.

Appropriately, the guided insertion of the rod 50, at the top, within the calibrated hole 64 formed in body 4 and on the bottom in the calibrated tubular stretch 67 of the outer covering element 52 minimizes clearance and wobble of the rod itself.

Furthermore, the covering element 52 is formed laterally a housing seat 69 for the pusher 58 which cooperates with the crown gear 57 of the contoured element 51.

Advantageously, the covering element 52 is internally provided with a contour 71, e.g. defined by a wall interposed between two steps, and which is contoured and arranged so as to allow the rotation of the rod 50 only after having applied a vertical push thereon. In particular, for this purpose, the contoured element 51 (which is integral with the rod 50) is provided with an appropriate projection 72 which, in the absence of a working rotation of the rod 50 with respect to the angular position 0°, is housed and locked inside the contour 71 and so the rotation of the rod 50 is only possible after having cleared the relief 72 from this contour 71 by means of an axial push of the rod itself.

A protective cap 60 is applied about the rod 50 and the covering element 52, preferably bellows-shaped and made of plastic or elastomeric material, to isolate the inner parts of the body 4 from the outside, and thus prevent the ingress of liquids, dirt or other material into the chambers of the said body. Appropriately, such cap 60 is axially locked at a suitable groove 66 obtained in the rod 50, whilst inferiorly it engages in an appropriate seat formed in a covering element 52 in order to avoid side displacements.

Advantageously, the outer covering element 52 also has an outer edge 59 which cooperates with the gas change adjustment screw 38 so as to keep it in position and prevent its extraction; in particular, this ensures the sealing of the fourth chamber 37—in which the adjustment screw 38 is housed—even if the screw is completely undone.

The operation of valve unit 2 according to the invention is as follows.

The valve unit 2 is actuated by the user by acting on the knob (not shown) which is attached to the rod 50 so as to be integral both in rotation and in translation.

When the control knob, with the rod 50, is kept in the angular position 0° and does not undergo any axial push, the valve unit 2 is located in the closing condition. In particular, in this condition, the safety valve 12 is kept by spring 14 in the closing condition so that its shutter 13 closes the passage 21 from the first chamber 20 towards the second chamber 22. Furthermore, in this condition, the disc-shaped element 40 is in the closing condition meaning that none of its through openings 42 or any area of the contoured through hole 49 faces the openings 45 of the sealing element 43 and of the main outlet hole 27 of the main chamber 28. In other words, the full portion of the crown 47 of the disc-shaped element 40 entirely covers the opening 45 of the sealing element 43 and of the main outlet hole 27.

Substantially, in this condition, the gas which enters from the inlet 9 does not cross the valve unit 2 and therefore does not reach the outlet 10 and thus an effective sealing of the unit itself is guaranteed.

To open the valve unit 2, in order to make gas reach a burner and thus allow its lighting, the user axially presses the knob, and then the control rod, and at the same time turns it counterclockwise to bring it to a given operating angle.

In particular, following the axial push of the rod 50, its lower end 61 comes into contact with the second arm 32 of the control linkage 30 and causes the rotation of the latter with respect to the annular element 34. More in detail, as a result of such rotation of the linkage 30, the first arm 31 of the linkage itself presses with its leg on the rod of the safety valve 12 to push it axially, i.e. to move the shutter 13 of the valve itself towards the opening condition of the passage 21, in contrast with the reaction of the spring 14. This allows the gas which is located in the first chamber 20—and which originates from the inlet 9 through the first conduit 24—to flow into the second chamber 22, from which it reaches the main chamber 28 through the second conduit 26.

In the absence of an operative rotation of the control knob and the rod 50 integral therewith with respect to the angular position 0°, the disc-shaped element 40 keeps its closing condition. Substantially, in this case, there is no escape of gas through the outlet 10 because the gas which reaches the main chamber 28 following the opening of the safety valve 12 remains blocked in this chamber because the main outlet hole 27 is closed/covered by a full portion of the disc-shaped element 40.

On the contrary, the counterclockwise rotation of the knob, and therefore of the rod 50, also causes a rotation of the disc-shaped element 40 which is integral in rotation with the rod itself. Appropriately, in rotation, the rod 50 is obliged to be positioned in a predetermined angular position which is defined by the engagement of the pusher 58, associated with the covering element 52, within one of the notches 62 of the crown gear 57 of the contoured element 51 integral with the rod itself. At said angular positions, a given and well-defined through opening 42 of the disc-shaped element 40 faces, either entirely or in part, the opening 45 of the sealing element 43 and of the main hole 27 so as to define a first passage zone (with a corresponding first passage section) to put the main chamber 28 into communication with the gas outlet 10 through the third conduit 29. In the case of disc-shaped elements 40 provided with a single contoured through opening 49 at such angular positions, a given and well-defined through zone of the contoured through opening 49 faces, either entirely or in part, the opening 45 of the sealing element 43 and the main hole 27, so as to define a first passage zone (with a corresponding first passage section) to put the main chamber 28 into communication with the gas outlet 10 through the third conduit 29.

So, the manual or automatic actuation of a traditional spark plug, associated with the burner (not shown on the drawings) to be supplied with the gas controlled by the valve unit 2, causes the ignition of the burner itself, the flames of which also act on a traditional thermocouple to generate a supply voltage of the electromagnet 17 to maintain the safety valve 12 open as a consequence also after releasing the knob and the rod 50.

Advantageously, the through openings 42 of the disc-shaped element 40 (Cf. FIG. 3*a*) have decreasing diameters (along a clockwise circumferential development direction) so that at each predetermined angular position of the rod 50—angular position which is set by the engagement of the pusher 58 in a corresponding notch 63 of the crown gear 57 of the contoured element 51—one (or more) different through opening 42 of the plurality of through openings of the disc-shaped element 40 defines a passage section/connection between the main chamber 28 and main outlet hole 27 which is different from, preferably smaller than, that defined by the previous opening.

Advantageously, the continuous through opening 49 of the disc-shaped element 40 (Cf. FIG. 3*b*) has a decreasing radial extension from zone 56 towards zone 54 (i.e. along a clockwise circumferential development direction) so that at each predetermined angular position of the rod 50—angular position which is set by the engagement of the pusher 58 in a corresponding notch 63 of the crown gear 57 of the contoured element 51—a different zone of the continuous contoured opening 49 defines a passage section/connection between the main chamber 28 and main outlet hole 27 which is different from, preferably smaller than, that defined by the previous zone of the opening itself. Appropriately, as said, the continuous contoured opening 49 may have any shape—e.g. in whole or in part increasing or decreasing, both in a progressive discontinuous manner (in steps)—so that at each predetermined angular position of the rod 50, the passage gap (section) defined by a determined area of the continuous contoured opening 49—area which is located facing said main outlet hole 27—is different from the passage gap (section) defined by the areas upstream and/or downstream of said determined area of the opening itself.

Substantially, the snapping rotation of the rod 50 causes also the snapping rotation of the disc-shaped element 40 integral therewith so as to connect/disconnect selectively the main chamber 28 with the gas outlet 10 and/or so as to vary the width of the connecting passage section between them in order to modulate the gas flow which by exiting from the valve unit 2 feeds a corresponding burner connected to the outlet 10 of the unit itself.

In particular, by turning by snapping, the rod 50 starting from the 0° position, the main outlet hole 27 is firstly connected with the main chamber 28 by means of the through opening 42 of the disc-shaped element 40 of greater diameter (Cf. FIG. 3*a*) or by means of the wider zone 56 of the continuous contoured opening 49 of the element itself (Cf. FIG. 3*b*)—or by means of any other terminal zone, suitably contoured or sized, of the continuous opening 49—whereby allowing a greater gas flow towards the outlet 10 and to reach the corresponding burner, controlled by the valve unit 2, the maximum power level. Subsequently, continuing the anticlockwise snapping rotation of the rod 50, the main outlet hole 27 is connected with the main chamber 28 by means of through openings 42 of gradually decreasing diameter or by means of zones of gradually narrower of the contoured opening 49—with corresponding decreasing gas flows which do not allow the burner to reach lower power levels—until achieving a final angular position, which identifies the minimum power level reached by the burner, in which the main outlet hole 27 is connected to the main chamber 28 by means of the through opening 42 of the disc-shaped element 40, which has the smaller diameter (Cf. FIG. 3*a*) or by means of the narrower region 54 of the contoured opening 49 made in the disc-shaped element A 40 (Cf. FIG. 3*b*).

Appropriately, at the final angular position of the rod 50, the different tightening, in the fourth chamber 37, of the gas change adjusting screw 38—which conveniently may be unscrewed to make its head abut on the outer edge 59 of the covering element 52—allows to vary the minimum gas flow through the bypass circuit 36,37,39—which is not controlled by the disc-shaped element 40—reaches the outlet 10 and this allows the valve unit 2 to be used with different types of gas. In particular, the axial position of the adjustment screw 38 inside its chamber 37 allows closing or modulating the gas flow which passes through the bypass circuit 36, 37 and 39.

More in detail, if LPG gas is used, the adjustment screw 38 is completely tightened inside the fourth chamber 37 so as to completely stop the gas flow through the bypass circuit 36, 37 and 39 reach the outlet 10, which therefore is only reached by the main gas flow which passes through the main outlet hole 27 and which is controlled by the disc-shaped element 40.

If methane gas is used, the adjustment screw 38 is appropriately unscrewed so that a bypass gas flow which passes through the circuit 36, 37 and 39 and is not controlled by the disc-shaped element 40 arrives at the output 10, in addition to the main gas flow which passes through the main outlet hole 27 and which is controlled by the disc-shaped element 40.

Appropriately, the safety valve 12 is always active for any angular position of the rod 50 and, therefore, a shutdown of the burner flames, at any power level set by the valve unit 2, takes the electrical interruption of the electromagnet 17 which, since it is no longer being supplied, causes a displacement of the shutter 13 in traditional manner, pushed by the spring 14, towards a closing position of the passage 21, whereby interrupting the gas flow between the first chamber 20, connected to the gas inlet 9, and the second chamber 22 connected to the main chamber 28.

From the above, it is apparent that the valve unit according to the invention is more advantageous than the traditional valve assemblies, and in particular:

by avoiding the use of a conical shape shutter, it allows a more effective sealing in closing condition but at the same time allows the modulation of the gas flow let out from the valve unit by varying the angular position of the control rod, the interaction between pusher and crown wheel defines a snapping rotation which is easily perceived on haptic level by the user and this allows to define a plurality of angular positions of the control rod, corresponding to an equal number of levels of the burner power levels, which are easily identifiable and repeatable, the presence of an elastic element, which pushes the disc-shaped element into contact with a seal, or with another sealing element, which is fixed and does not rotate, ensures a high level of tightness of the valve unit, a possible overpressure of the inlet gas, and thus inside the main chamber, tends to push the disc-shaped element against the seal, whereby ensuring the sealing of the valve unit also beyond the pressure and flow limit conditions, the modulation of the outlet gas flow from the valve unit, and thus of the power levels of the burner, are easily and highly customizable simply by varying the diameters of the through holes formed on the disc-shaped element, the number of power levels of the burner are easily and highly customizable simply by varying the number of recesses (for snap engagement with the pusher) provided in the crown gear of the contoured element, it can be used with any type of gas and also allows to change the gas type to be used in the valve unit (e.g. from methane to LPG or vice versa) simply by acting on a gas change screw which is located in a position which is easily accessible from the outside, the fact that the control rod is retained externally by the calibrated hole made in the covering element and internally by the calibrated hole obtained in the body allows to reduce the wobble of the rod itself, the use of the cap allows a complete insulation of the internal components of the valve unit from the accidental introduction of liquids or other external substances, it is very compact and can be housed even in a rather small space, it can be made at low industrial cost.

In particular, unlike known solutions, and in particular unlike GB662896 and CN201103717, the solution according to the present invention is the only one which has a disc provided itself with a plurality of zones of different passage sections so as to allow different gas passages from the main chamber towards the gas outlet and which, at the same time, can rotated in snapping manner by rotating the control unit. In particular, advantageously, such solution—despite being simple constructively—allows a precise, reliable and accurate adjustment of the valve unit between multiple mutually distinct opening conditions.

The invention claimed is:

1. A gas valve unit, comprising:

a body (4) provided with a gas inlet (9), fluidically connectable to a gas source and to at least one outlet (10);

a main chamber (28), defined at least in part in said body (4), said main chamber being in fluid communication with said gas inlet (9) and provided with a main outlet hole (27) in fluid communication with said at least one outlet (10);

a disc-shaped element (40), which is housed in said main chamber (28), is provided with one or more through openings (42, 49) defining at least two zones, the one or more through openings providing a different passage section for the gas in order to put said main chamber (28) in communication with said main outlet hole (27), said disc-shaped element (40) being rotatable within said chamber (28) between at least one closing position, in which said main outlet hole (27) is entirely covered by a full portion of said disc-shaped element (40), and at least two distinct opening positions in each of which a corresponding and distinct passage zone defined by said one or more openings (42, 49) of said disc-shaped element (40) faces, at least in part, said main outlet hole (27) so as to allow a passage of the gas from said chamber (28) to said main outlet hole (27) through said passage section; and a control unit (3) associated with said body (4) and configured to cause a snapping rotation of said disc-shaped element (40) between said at least one closing position and one of said at least two distinct opening positions, and to cause the snapping rotation of said disc-shaped element (40) between said at least two distinct opening positions, said control unit (3) comprising a first element that is integral in rotation with a rod and that cooperates by snap-engaging with a second element that is integral with said body so as to define the snapping rotation that provides a user with a sensitive tactile perception of a movement of said control unit between said at least one closing position and one of said at least two distinct opening positions, and also between said at least two distinct opening positions.

2. The gas valve unit according to claim 1, further comprising a sealing element (43), which is fixed and has at least one through opening (45) facing said main outlet hole (27), and which is interposed between the main outlet hole (27) and said disc-shaped element (40).

3. The gas valve unit according to claim 2, wherein said sealing element (43) comprises a seal interposed between said disc-shaped element (40) and a wall of said main chamber (28) at which said main outlet hole (27) is formed.

4. The gas valve unit according to claim 2, further comprising an elastic element (53), which is housed in said main chamber (28) and which acts on said disc-shaped element (40), so as to push said disc-shaped element towards a wall of said main chamber (28) at which said main outlet hole (27) is obtained.

5. The gas valve unit according to claim 4, wherein said elastic element (53) comprises a solenoid spring associated with the control unit (3) and acting on one face of the disc-shaped element (40) so as to push another other face of the disc-shaped element into contact with said sealing element (43).

6. The gas valve unit according to claim 4, wherein said control unit (3) comprises a rod (50), which has a first portion outside of said body (4) and is configured to be associated with a control knob, and a second portion inside said body (4) that is integral in rotation with said disc-shaped element (40).

7. The gas valve unit according to claim 6, wherein one end of the elastic element (53) acts on the disc-shaped element (40), while another end of said elastic element (53) acts on an abutment integral with said rod (50).

8. The gas valve unit according to claim 1, further comprising a first housing chamber (20) of a safety valve (12), said first housing chamber (20) being fluidly interposed between said gas inlet (9) and said main chamber (28) of said disc-shaped element (40).

9. The gas valve unit according to claim 8, wherein said control unit (3), which is configured to cause the snapping rotation of said disc-shaped element (40), is also configured to cause an opening of said safety valve (12).

10. The gas valve unit according to claim 1, wherein said at least two zones are defined exclusively in said disc-shaped element (40).

11. The gas valve unit according to claim 1, wherein said main chamber (28) is put into fluid communication with the gas inlet (9) independently from an angular position of said disc-shaped element (40).

12. The gas valve unit according to claim 1, wherein the one or more through openings are a plurality of through openings (42), which defines the at least two zones having different passage cross sections, and which comprises a plurality of openings of various sizes and separated from one another.

13. The gas valve unit according to claim 1, wherein said one or more through openings (43), which define the at least two zones having different passage cross sections, is a single through opening (49) which is continuous and which is contoured so as to vary a passage gap along its extension.

14. The gas valve unit according to claim 1, further comprising at least one bypass circuit (36, 37) inside said body (4), said at least one bypass circuit putting said main chamber (28) of said disc-shaped element (40) into fluid communication with said at least one outlet (10), whereby bypassing said disc-shaped element (40).

15. The gas valve unit according to claim 1, wherein the one or more through openings (42, 49) of the disc-shaped element (40) have decreasing diameters according to a circumferential clockwise extension direction.

16. The gas valve unit according to claim 1, wherein said one or more through openings are a plurality of through openings.

17. A gas valve unit, comprising:

a body (4) provided with a gas inlet (9), fluidically connectable to a gas source and to at least one outlet (10);

a main chamber (28), defined at least in part in said body (4), said main chamber being in fluid communication with said gas inlet (9) and provided with a main outlet hole (27) in fluid communication with said at least one outlet (10);

a disc-shaped element (40), which is housed in said main chamber (28), is provided with one or more through openings (42, 49) defining at least two zones, the one or more through openings providing a different passage section for the gas in order to put said main chamber (28) in communication with said main outlet hole (27), said disc-shaped element (40) being rotatable within said chamber (28) between at least one closing position, in which said main outlet hole (27) is entirely covered by a full portion of said disc-shaped element (40), and at least two distinct opening positions in each of which a corresponding and distinct passage zone defined by said one or more openings (42, 49) of said disc-shaped element (40) faces, at least in part, said main outlet hole (27) so as to allow a passage of the gas from said chamber (28) to said main outlet hole (27) through said passage section;

a control unit (3) associated with said body (4) and configured to cause a snapping rotation of said disc-shaped element (40) between said at least one closing position and one of said at least two distinct opening positions, and to cause the snapping rotation of said disc-shaped element (40) between said at least two distinct opening positions;

a sealing element (43), which is fixed and has at least one through opening (45) facing said main outlet hole (27), and which is interposed between the main outlet hole (27) and said disc-shaped element (40); and an elastic element (53), which is housed in said main chamber (28) and which acts on said disc-shaped element (40), so as to push said disc-shaped element towards a wall of said main chamber (28) at which said main outlet hole (27) is obtained, wherein said control unit (3) comprises a rod (50), which has a first portion outside of said body (4) and is configured to be associated with a control knob, and a second portion inside said body (4) that is integral in rotation with said disc-shaped element (40), and wherein said control unit (3) comprises a first element (57) that is integral in rotation with said rod (50) and cooperates by snap-engaging with a second element (58) that is integral with said body (4), and wherein said first element comprises a crown gear (57), and wherein said second element comprises a pusher (58) which is engaged in snapping manner within notches (63) defined between teeth (62) of the crown gear (57), or vice versa.

18. The gas valve unit according to claim 17, wherein an engagement of the pusher (58) in a given notch (63) of the crown gear (57) corresponds to a given connection condition between the main chamber (28) and the main outlet hole (27) by a given passage section, which is defined by said one or more through openings (42, 49) of said disc-shaped element (40), and which is different from the passage section expected when the pusher (58) engages other notches (63) of the crown gear (57).

19. The gas valve unit according to claim 17, wherein said first element (57) is interposed between an outer portion and an inner portion of said rod (50), and wherein said second element (58) is associated with an outer covering element (52), which is fixed to said body (4).

20. A gas valve unit, comprising:

a body (4) provided with a gas inlet (9), fluidically connectable to a gas source and to at least one outlet (10);

a main chamber (28), defined at least in part in said body (4), said main chamber being in fluid communication with said gas inlet (9) and provided with a main outlet hole (27) in fluid communication with said at least one outlet (10);

a disc-shaped element (40), which is housed in said main chamber (28), is provided with one or more through openings (42, 49) defining at least two zones, the one or more through openings providing a different passage section for the gas in order to put said main chamber (28) in communication with said main outlet hole (27), said disc-shaped element (40) being rotatable within said chamber (28) between at least one closing position, in which said main outlet hole (27) is entirely covered by a full portion of said disc-shaped element (40), and at least two distinct opening positions in each of which a corresponding and distinct passage zone defined by said one or more openings (42, 49) of said disc-shaped element (40) faces, at least in part, said main outlet hole (27) so as to allow a passage of the gas from said chamber (28) to said main outlet hole (27) through said passage section;

a control unit (3) associated with said body (4) and configured to cause a snapping rotation of said disc-shaped element (40) between said at least one closing position and one of said at least two distinct opening positions, and to cause the snapping rotation of said disc-shaped element (40) between said at least two distinct opening positions;

a sealing element (43), which is fixed and has at least one through opening (45) facing said main outlet hole (27), and which is interposed between the main outlet hole (27) and said disc-shaped element (40); and an elastic element (53), which is housed in said main chamber (28) and which acts on said disc-shaped element (40), so as to push said disc-shaped element towards a wall of said main chamber (28) at which said main outlet hole (27) is obtained, wherein said control unit (3) comprises a rod (50), which has a first portion outside of said body (4) and is configured to be associated with a control knob, and a second portion inside said body (4) that is integral in rotation with said disc-shaped element (40), and wherein said control unit (3) comprises a first element (57) that is integral in rotation with said rod (50) and cooperates by snap-engaging with a second element (58) that is integral with said body (4), and wherein said sealing element (43) has a central hole (44), which is crossed by the rod (50) of the control unit (3) and which has a larger cross-section than a cross-section of the rod (50) and of the disc-shaped element (40) so that the sealing element (43) remains immobile and is independent from rotations of the rod (50) that crosses the sealing element.

* * * * *